United States Patent [19]

Kobayashi

[11] Patent Number: 4,979,745

[45] Date of Patent: Dec. 25, 1990

[54] ELECTRIC APPARATUS FOR USE WHEN PRACTICING A GOLF SWING

[75] Inventor: Masashi Kobayashi, Chiba, Japan

[73] Assignee: Maruman Golf Co. Ltd., Tokyo, Japan

[21] Appl. No.: 315,092

[22] Filed: Feb. 24, 1989

[30] Foreign Application Priority Data

Feb. 26, 1988 [JP] Japan ..... 63-43761

[51] Int. Cl.[5] ..... A63B 69/36

[52] U.S. Cl. ..... 273/186 R; 273/183 R; 273/186 A; 273/185 R

[58] Field of Search ..... 273/186 D, 29 R, 29 A, 273/26 R, 26 B, 183 R, 183 A, 183 D, 186 R, 186 A, 186 B, 195 R, 194 A, 164, 185 B; 434/252, 247; 340/323 R

[56] References Cited

U.S. PATENT DOCUMENTS

| | | | |
|---|---|---|---|
| 3,194,563 | 7/1965 | MacKniesh | 273/186 R |
| 4,150,825 | 4/1979 | Wilson | 273/185 B |
| 4,180,726 | 12/1979 | DeCrescent | 273/26 R |
| 4,251,077 | 2/1981 | Pelz et al. | 273/186 A |
| 4,306,722 | 12/1981 | Rusnak | 273/186 R |
| 4,583,733 | 4/1986 | Ito et al. | 273/26 B |
| 4,630,829 | 12/1986 | White | 273/186 A |
| 4,652,121 | 3/1987 | Ito et al. | 273/26 B |

*Primary Examiner*—William H. Grieb
*Assistant Examiner*—Jessica J. Harrison
*Attorney, Agent, or Firm*—Armstrong, Nikaido, Marmelstein, Kubovcik and Murray

[57] ABSTRACT

In an apparatus used for practicing a golf swing, a transmitter-receiver is stationarily arranged on the ground, and a relay unit is provided on the golf club in or near to head. The transmitter-receiver has an infrared light emitter and a pair of receivers. The relay unit has a receiver for receiving the light from the emitter of the transmitter-receiver and a infrared ray emitter for emitting a ray toward the pair of receivers of the transmitter-receiver. An LSI is provided for processing the light received by the pair of receivers separately, for detecting a change in intensity at time elapses for calculating the direction of the swing, and the timing of a maximum intensity for obtaining the head speed.

17 Claims, 19 Drawing Sheets

10 μs
1.25μs
Fig. 14(a) CLK t0
t1
t2
t3
t4
t5
t6
t7
Fig. 14(c) 21 or 22 S=S0
t0 t4 t0 t4 t0 t4
Fig. 14(d) 32 RR
Fig. 14(e) 31 RS
Fig. 14(f) 241 or 242 X=Y, X=Z
t2 t6 t2 t6 t2

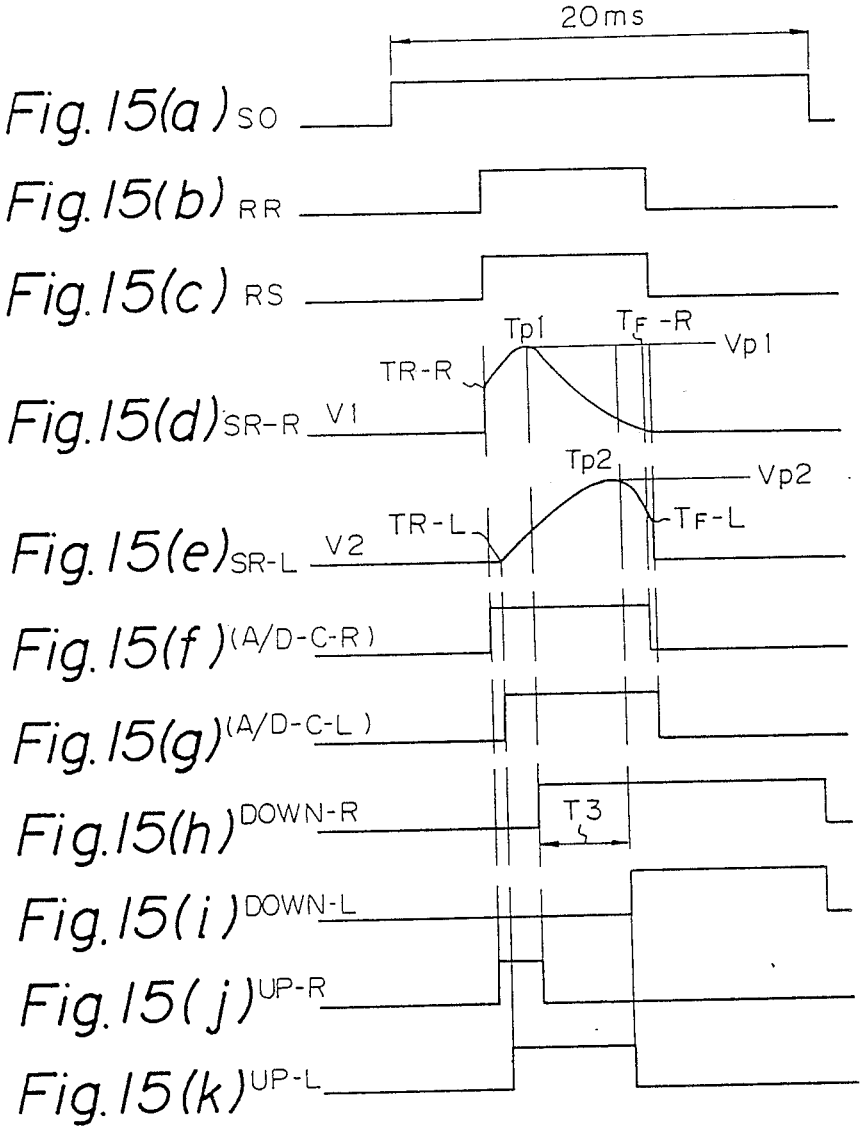
20ms
Fig.15(a) SO
Fig.15(b) RR
Fig.15(c) RS
Tp1
TF-R
Vp1
TR-R
Fig.15(d) SR-R
V1
Tp2
Vp2
TR-L
TF-L
Fig.15(e) SR-L
V2
Fig.15(f) (A/D-C-R)
Fig.15(g) (A/D-C-L)
Fig.15(h) DOWN-R
T3
Fig.15(i) DOWN-L
Fig.15(j) UP-R
Fig.15(k) UP-L

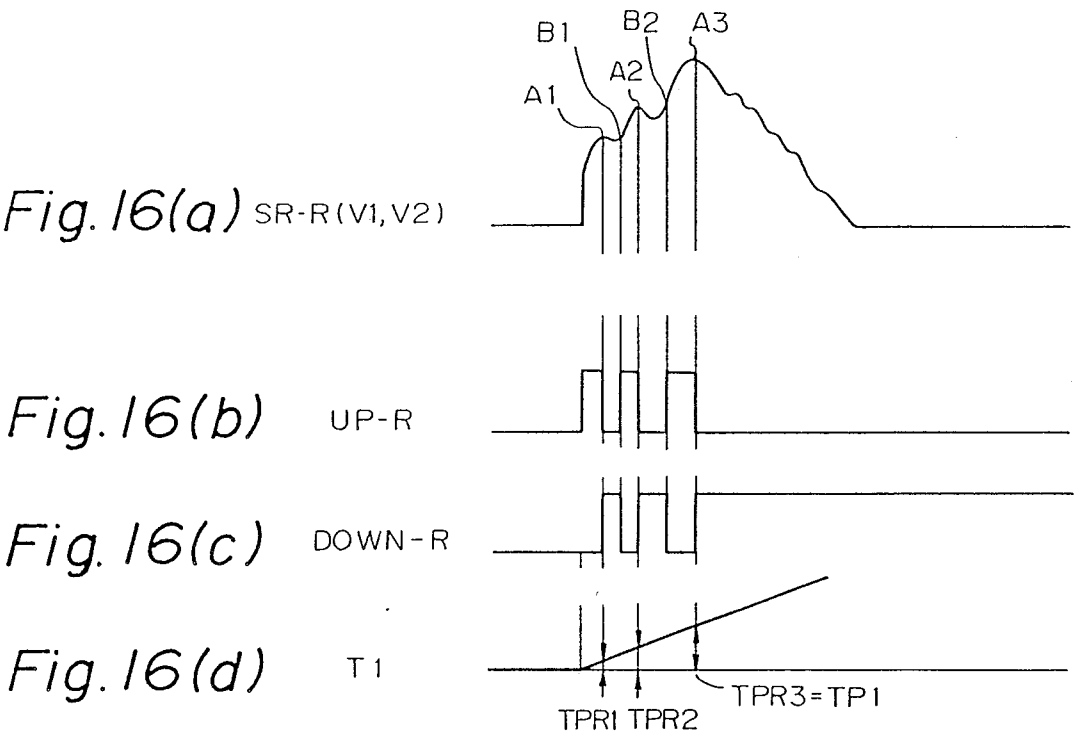
Fig. 16(a) SR-R(V1, V2)
Fig. 16(b) UP-R
Fig. 16(c) DOWN-R
Fig. 16(d) T1

1
2
901
DISPLAY
902
S=S1000
903
X=S1000
N
904
ADDRESS BEEP
905
S=S100
906
X=S100
Y
N
907
S=S100
WAGGLE
IMPACT
913
S=So
914
X=Y
N
Y
914-1
Vp1 = V1
914-2
T1 = T1+1
914-3
DOWN-R F/F SET
N
Y
914-4
Tp1 ← T1
918
Tp1+Tp2=0
Y
N
919
Tp1=0
Y
N
920
Tp2=0
Y
N
921
Vp1=Vp1·C
922
D1=DO√Vo/Vp1
922-1
Vp2=Vp2·C
922-2
D2=DO√Vo/Vp2
933
ERROR 1
934
ERROR 2
935
ERROR 3
WAIT
ADDRESS
BACK SWING

ELECTRIC APPARATUS FOR USE WHEN PRACTICING A GOLF SWING

BACKGROUND OF THE INVENTION

1. Field of the Invention

The present invention relates to an electronic apparatus for use when practicing a golf swing, which apparatus is compact and easily portable, and can be used to measure a speed of a golf club head, a degree of inclination of a face of the golf club head, and a degree of inclination of an axis of a swing of a golf club with respect to a golf ball, at any location.

2. Description of the Related Art

Various types of electronic apparatuses for use when practicing a swing of a golf club are known, but these are all of the type that measures a particular characteristic of a swing movement, and therefore, it has not been possible to measure all of the characteristics of a swing movement at the same time. Furthermore, the prior art apparatuses are usually large and accordingly, difficult to transport, and thus can be used only at a specific location. Therefore, an easily portable and compact electronic apparatus for use when practicing a golf swing is urgently required.

SUMMARY OF THE INVENTION

According to the present invention, the apparatus for use when practicing a golf swing provides with a compact infrared ray transmitter-receiver for detecting a swing characteristic, and a relay unit mounted on the head of a golf club.

The transmitter-receiver comprises an infrared ray transmitter for transmitting light to the relay unit mounted on the golf club head an infrared ray receiver for receiving light relayed by the relay unit, an LSI unit for data processing, and a display and alarm unit. The use of an LSI allow the production of a compact electronic unit.

The relay unit comprises a infrared ray receiving element, an operating amplifier, a delay circuit, a stabilized power circuit an infrared ray generating element, and a button-type battery. The use of a miniaturized integrated circuit for the electronic circuit in the relay unit allows the unit to be arranged in the head or shaft of the golf club.

Furthermore, the light emitted from the light transmitter is received by two separate infrared ray receivers, and any change in the intensity of the light received by the two light receivers is detected by an analog to digital converter. The timing of a generation of a peak in the light intensity is detected by a peak holder circuit, and is input to the programmed LSI. The LSI is provided with programs for measuring the speed of the golf club head by determining the difference in the times at which generation of a peak intensity occurs by detecting same at the two light receiving elements.

BRIEF EXPLANATION OF THE DRAWINGS

FIGS. 15(*a*), 15(*b*), 15(*c*), 15(*d*), 15(*e*), 15(*f*), 15(*g*), 15(*h*), 15(*i*), 15(*j*) and 15(*k*) are timing charts illustrating a measurement signal (S), light receiving signal (RR) from the transmitter receiver, light receiving signal (RS) at the relay unit, the voltage level (VI) of the receiving signal received by the right receiving element, the voltage level (V2) of the receiving signal received by the right receiving element, A/D conversion signal (A/D-C-R) by the right A/D converter, A/D conversion signal (A/D-C-L) by the left A/D converter, operating signal of the right side flip flop DOWN-R reset by detecting a peak, operating signal of the left side flip-flop DOWN-L reset by detecting a peak, operating signal of the right side flip-flop UP-R set by detection of a peak, and operating signal of the left side flip flop UP-L set by detection of a peak, respectively;

FIGS. 16(*a*) 16(*b*), 16(*c*) and 16(*d*) are timing charts illustrating SR-R, UP-R, DOWN-R and respectively when a plurality of peaks is detected;

DESCRIPTION OF THE PREFERRED EMBODIMENTS

An embodiment of the present invention will be described with reference to the attached drawings.

Figure 1:
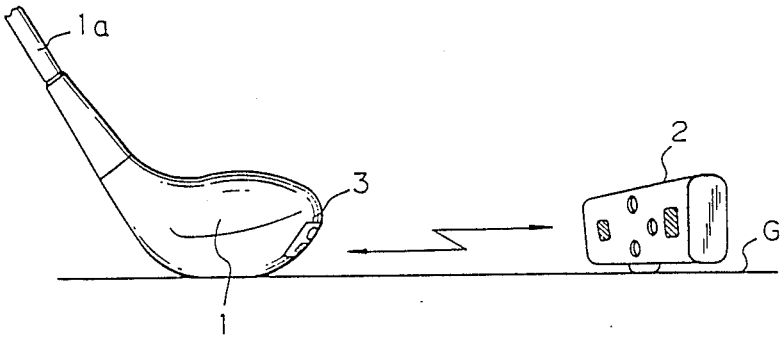
FIG. 1 a schematic side view illustrating the use of the apparatus according to the present invention.

FIG. 1 shows a combination of a transmitter-receiver unit 2 and a relay unit 3. The transmitter-receiver unit 2 is located on the ground G, and the relay unit 3 is housed in a toe portion of a head 1 of a golf club, so that the transmitter-receiver unit 2 and the relay unit 3 face each other at a distance of, for example, 20 cm; note, 1*a* denotes a shaft of the golf club.

Figure 2:
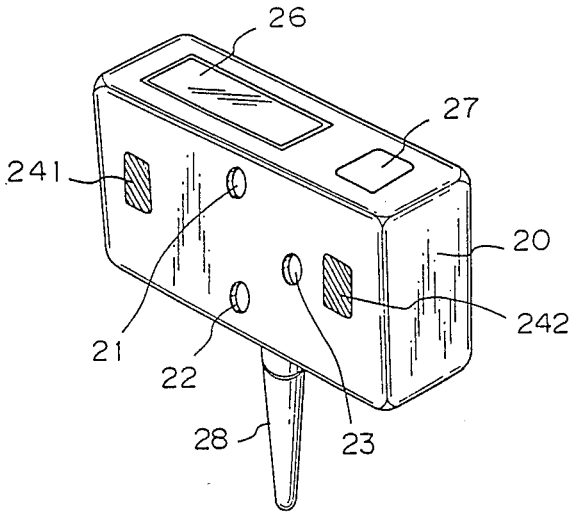
FIG. 2 is a perspective view of the transmitter-receiver.

FIG. 2 shows a perspective view of the transmitter-receiver 2, in which 23 denotes an infrared ray emitter element as a searcher, 21 and 22 denote vertically spaced infrared ray emitter elements as sensors, 241 and 242 denote infrared ray receivers 26 denotes an indicator, 27 denotes a key unit, and 28 denotes a fixing pin inserted into the ground as a tee for a wood club.

Figure 3:
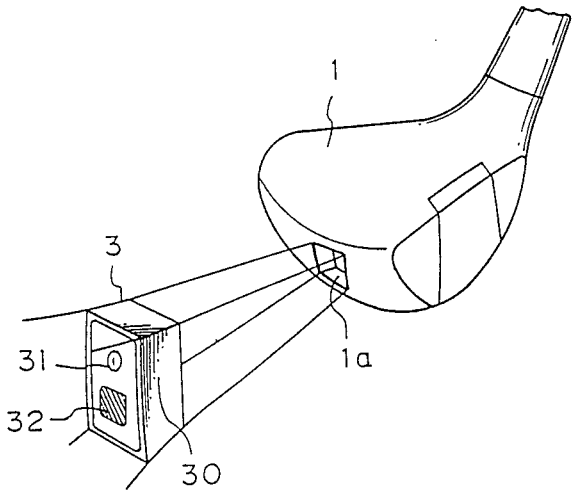
FIG. 3 is a perspective view of a relay unit separated from the head.
Figure 4:
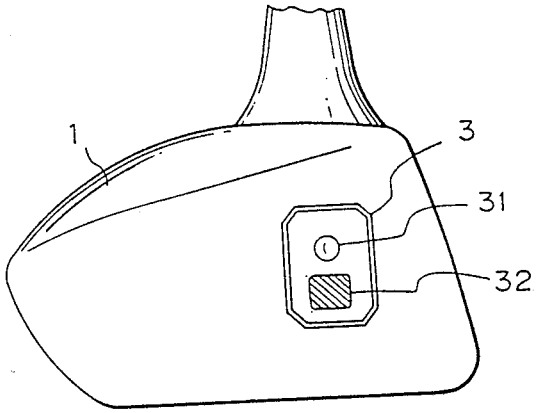
FIG. 4 is a front view of the head having the relay unit mounted thereon.

In FIG. 3 showing a perspective view of the relay unit 3, 31 denotes an infrared ray emitter element, and 32 denotes an infrared ray receiver. A casing 30 is provided for storing the emitter 31 and the receiver 32. The golf club head 1 has a rectangular shaped recess 1*a* formed at the front edge portion (toe) thereof, in which the casing 30 of the relay unit 3 is fixedly inserted. See also FIG. 4.

Figure 5:
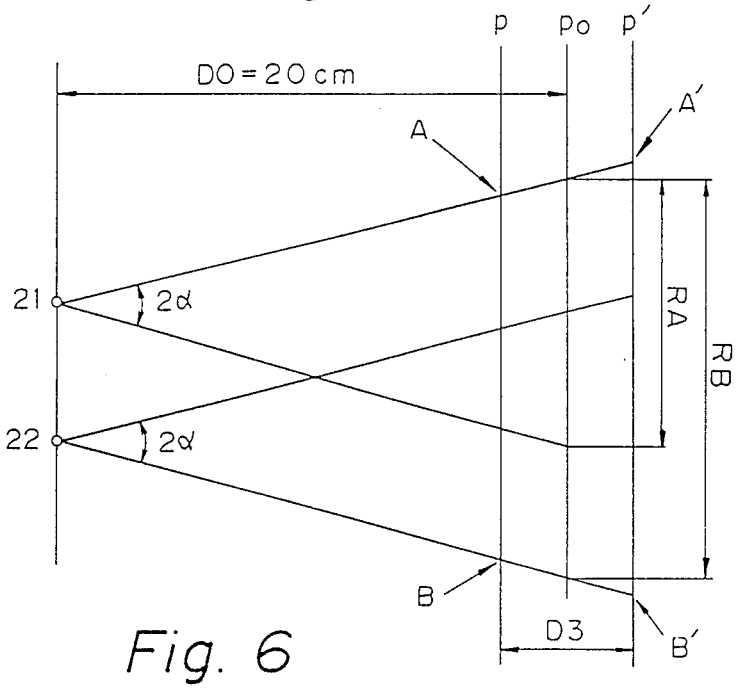
FIG. 5 is a diagrammatic side view in the vertical plane illustrating the conical angle of rays transmitted from the transmitter-receiver unit to the relay unit in the golf club head.
Figure 6:
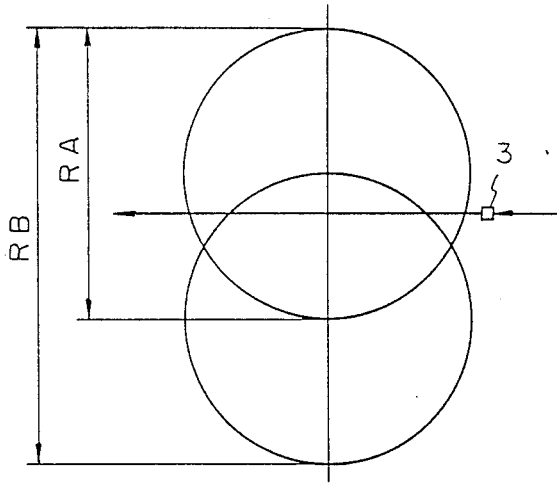
FIG. 6 is front view of search areas taken along line $p_0$ in FIG. 5.

FIG. 5 is a vertical side view schematically illustrating conical beams from the infrared ray emitters 21 and 22, each having an angle of divergence of $2\alpha$. In a plane $p_0$ perpendicular to the ground at a distance of 20 cm from the emitters 21 and 22, circular areas designated by RA are illuminated by each beam. The plane $p_0$ corresponds to the standard distance D0=20 cm between the transmitter receiver 2 and the relay unit 3. These circular areas are superimposed at the inner parts thereof as shown in FIG. 6. The relay unit 3 passes through the superimposed portions to receive the light from the transmitter-receiver 2 and to transmit the light to the transmitter-receiver 2 during a swing of the club, as will be later described. The relay unit 3 moves along a line denoted by arrows in FIG. 6 together with the head 1. The total vertical extent illuminated by the emitters 21 and 22 at the plane $p_0$ is designated by RB. At planes p and p' equally spaced from the plane $p_0$, of the mutual distance D3, in the direction parallel to the axis of the beams, the vertical extents of illumination of the emitters 21 and 22 are designated by A-B and A'-B', respectively.

Figure 7:
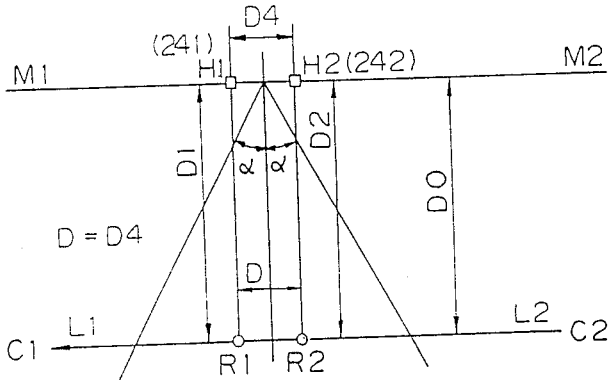
FIG. 7 diagrammatically shows the relationship between the positions (H1 and H2) of light receiving elements of the transmitter-receiver with respect to the positions (R1 and R2) of the relay unit obtaining the maximum intensity of the received light when a straight swing is made with a perpendicular relationship between the face of the head and the pass of the swing.
Figure 8:
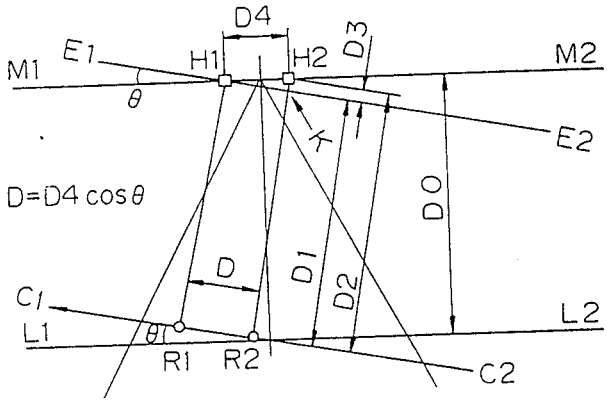
FIG. 8 is the same as FIG. 7, except that the swing is made from the inside to the outside.
Figure 9:
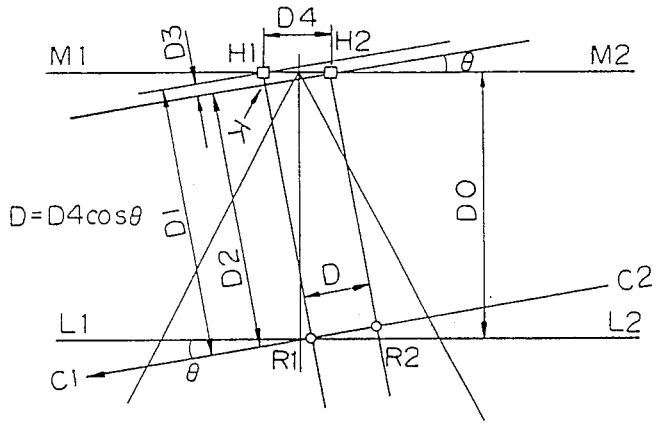
FIG. 9 is the same as FIG. 7, except that the swing made from the outside to the inside.
Figure 10:
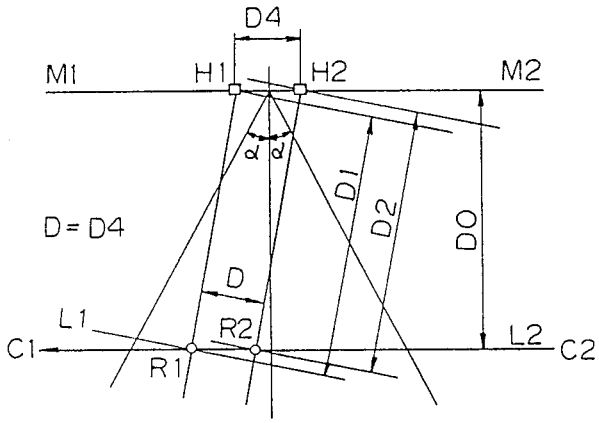
FIG. 10 diagrammatically shows the relationship between the positions (H1 and H2) of light receiving elements of the transmitter-receiver with respect to the positions (R1 and R2) of the relay unit obtaining the maximum intensity of the received light when a straight swing is made while the face of the head is inclined in "slice" direction to the pass of the swing.
Figure 11:
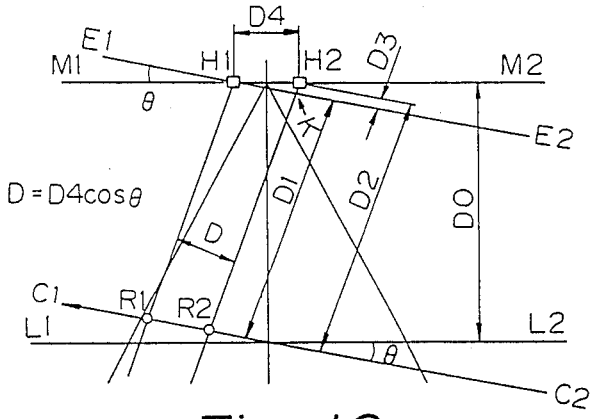
FIG. 11 is the same as FIG. 10, except that the swing is made from the inside to the outside.
Figure 12:
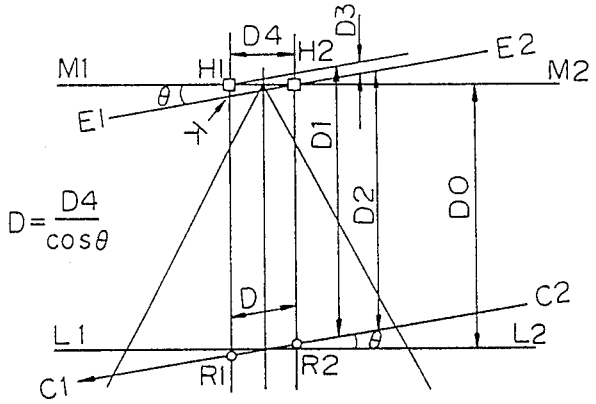
FIG. 12 is the same as FIG. 10, except that the swing is made from the outside to the inside.

In FIGS. 7 and 10, the passage of the golf club head during a straight swing is illustrated; in FIGS. 8 and 11, a passage of the golf club head during an inside-to-outside swing is illustrated; and in FIGS. 9 and 12, a passage of the golf club head during an outside-to-inside swing is illustrated.

FIGS. 7, 8, and 9 show a situation wherein the face of the head the golf club is perpendicular with respect to the passage of the swing, and FIGS. 10, 11 and 12 show a situation wherein the face of the head of the golf club is inclined in a slice direction.

Figure 24:
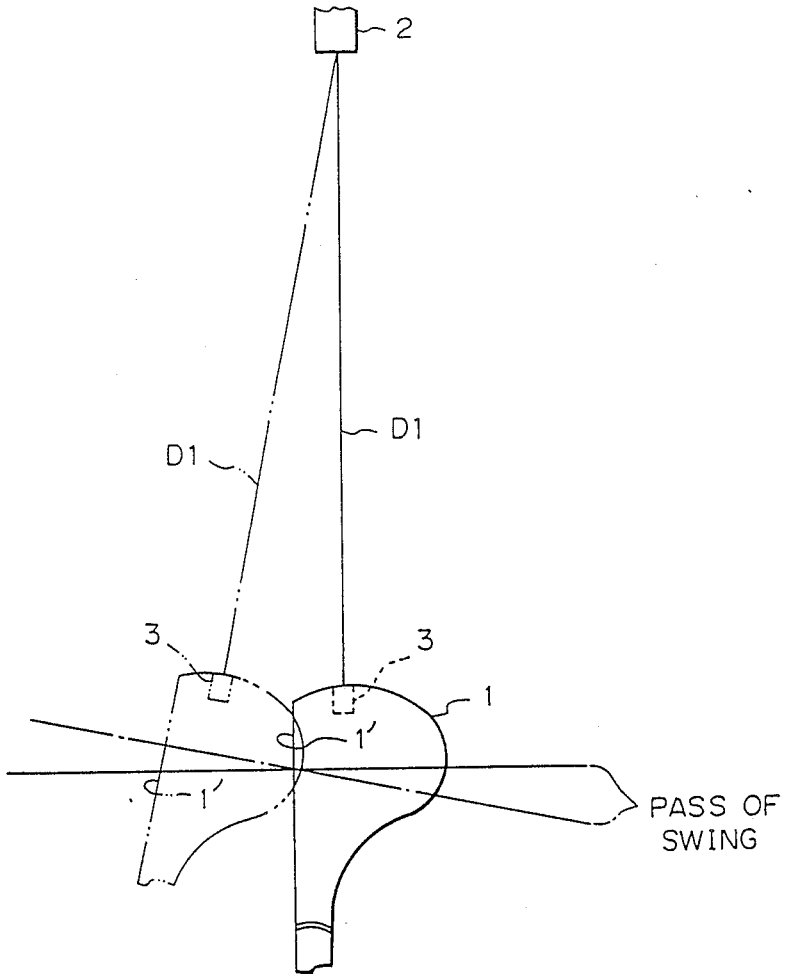
FIG. 24 is a schematic view illustrating relationships between the head and transmitter-receiver for attaining the maximum intensity of light in accordance with the direction of the pass of the swing; and, FIG. 25 is a schematic view illustrating relationships between the head and transmitter-receiver for attaining the maximum intensity of light in accordance with the arrangement of the face of the head to the pass of the swing.

FIG. 24 illustrates a change of position of the head for obtaining a maximum intensity of light received by the relay unit 3 when the swing angle is changed. On the straight swing, as shown by the solid line, the maximum intensity position is at the point at which the relay unit 3 faces the relay unit along the line D1, which is parallel to the face 1' of the head 1. In an angled swing, such as an outside to inside swing as illustrated by the dotted line, the maximum intensity is also obtained when the line of the distance connecting the parts 2 and 3 is parallel to the face 1' of the head 1, but due to the angle of the passage of the golf club head during the swing, the position of maximum intensity is different to that of a straight swing.

Figure 25:
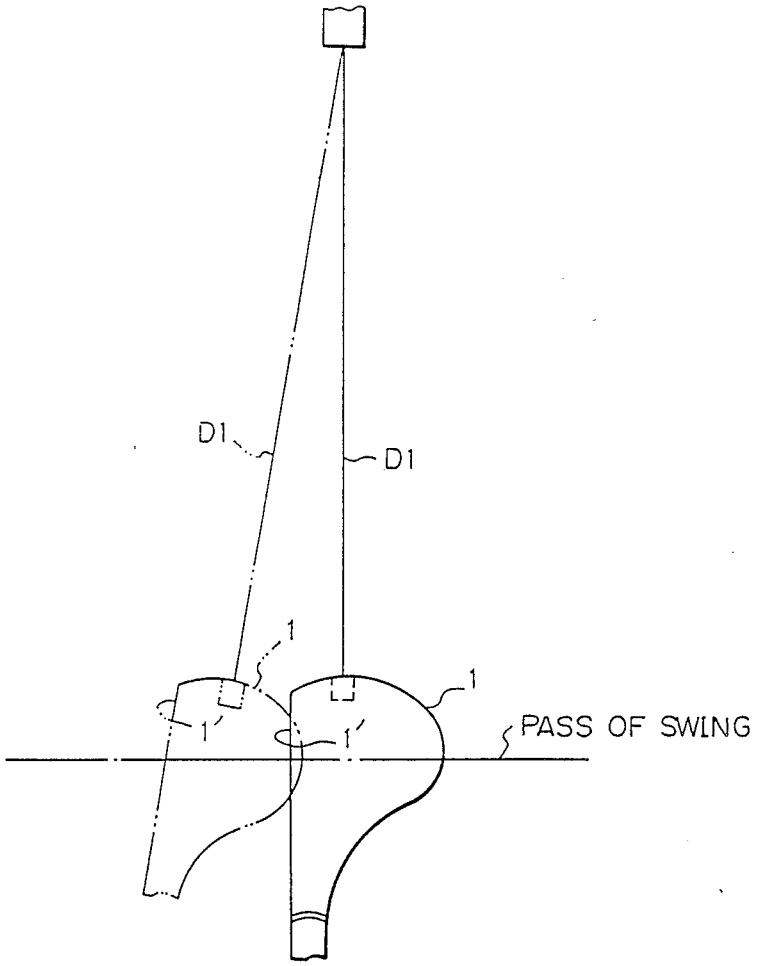

FIG. 25 illustrates a change of the position of the golf club head 1 for obtaining a maximum intensity of light received by the relay unit 3 when the direction of the face of the head is changed. During a normal swing, as shown by the solid line, where the face 1' is substantially perpendicular to the direction of passage of the swing, the maximum intensity position is at the point at which the relay unit 3 faces the relay unit along the line D1, which is parallel to the face 1' of the golf club head 1. During a "slice" swing, where the face 1 has an angle with respect to the passage of the swing, the maximum intensity is also obtained when the line of the distance connecting the parts 2 and 3 is parallel to the face 1' of the head 1 but due to the sliced, the position of maximum intensity is different to that of the correct swing.

In FIGS. 7 to 12, H1 and H2 designated the positions of receivers 241 and 242, respectively; R1 designates the position of the relay unit 3 for obtaining a maximum intensity of light received by the receiver 241, wherein a distance between the receiver unit 241 (H1) and the relay unit 3 (R1) is designated by D1; and R2 designates a position of the relay unit 3 for obtaining a maximum intensity of light received by the receiver 242, wherein a distance between the receiver unit 242 (H2) and the relay unit 3 (R2) is designated by D2. A line on which the positions H1 and H2 of the receiver 241 and 242 are located is designated by M1-M2; a line L1-L2 is spaced parallel from the line M1-M2 at a distance D0 in a plane parallel to the ground; a passage of the relay unit 3 upon the swing of the golf club head is designated by a line C1-C2, on which the positions R1 and R2 are located; a line E1-E2 is spaced parallel from the line C1-C2, on which line E1-E2 the position of H1 or H2 is located; an intersection of the line E1-E2 and the line H1-R1 or H2-R2 is designated by K; and swing angle is defined by the angle $\theta$ formed by an intersection of the line C1-C2 designating the passage of the head during a swing with respect to the fixed line L1-L2 in FIG. 8, in a triangle H1-H2-K, the swing angle $\theta$ is designated by an apex angle between the sides H1-H2 and H1-K, and in FIG. 9, in a triangle H1-H2-K, the swing angle $\theta$ is designated by an apex angle between the sides H1-H2 and H2-K.

As will be clear from the above, when a distance between the positions H1 and H2 of the receivers 241 and 242 is denoted by D4, and D3 is the distance between H1 and R1 subtracted by the distance between H2 and R2(=D1−D2), the swing angle $\theta$ is obtained by the following equation $$\sin\theta = D3/D4 \text{ or}$$

$$\sin\theta = (D1-D2)/D4$$

The straight swing corresponds D1=D2, the inside-to-outside swing corresponds to D1<D2, and the outside-to-inside swing corresponds to D1>D2

When the face of the club head is inclined, the swing angle $\theta$ is designated by the following equation respectively, in the case of FIG. 11, $$\sin\theta = (D1-D2)/D4$$

and, in the case of FIG. 12, $$\tan\theta = (D1-D2)/D4$$

It should be noted that a following approximated equation can be obtained when the angle $\theta$ is small, $$\tan\theta = \sin\theta = (D1-D2)/D4$$

Furthermore, the distance D on the line R2-R1 between points R1 and R2 for obtaining the maximum intensity of light emitted from the relay unit is equal to the distance H1 and K or H2 and K in FIG. 11 or FIG. 12, respectively. This distance D is designated by:

$$D = D4\cos\theta$$

in FIG. 11

$$D = D4\cos\theta$$

in FIG. 12

Therefore, in either FIG. 11 or 12 the distance D between the left side point and right side point for obtaining the peak intensity at the receiving units, which is equal to R1−R2, is designated by the following equation.

$$D = R1 - R2.$$

Figure 13:
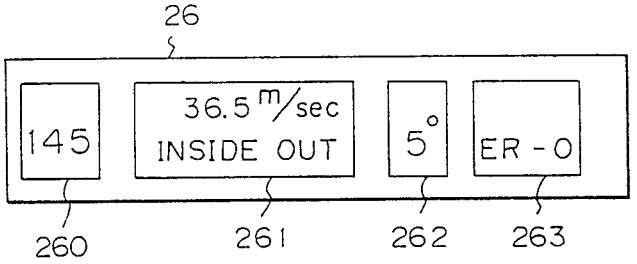
FIG. 13 is a typical view of the display.

FIG. 13 shows the display 26 which comprises a part 260 for indicating the number of swings made, a part 261 for indicating the type of swing and the speed of the club head, a part 262 for indicating the swing angle $\theta$, and a part 263 for indicating the identification of an error swing. In an example shown in FIG. 13, the swing number is 145, the swing is inside to outside, the swing angle is 5 degrees, the club head speed is 36.5 m/sec, and the identification of the error swing is ER-0. The meaning of the error identification number will be described later.

It should be noted that the ER-0 indication is generated upon the 146th swing, and the data of the swing passage as indicated is that obtained at the preceding 145th swing.

Figure 14B:
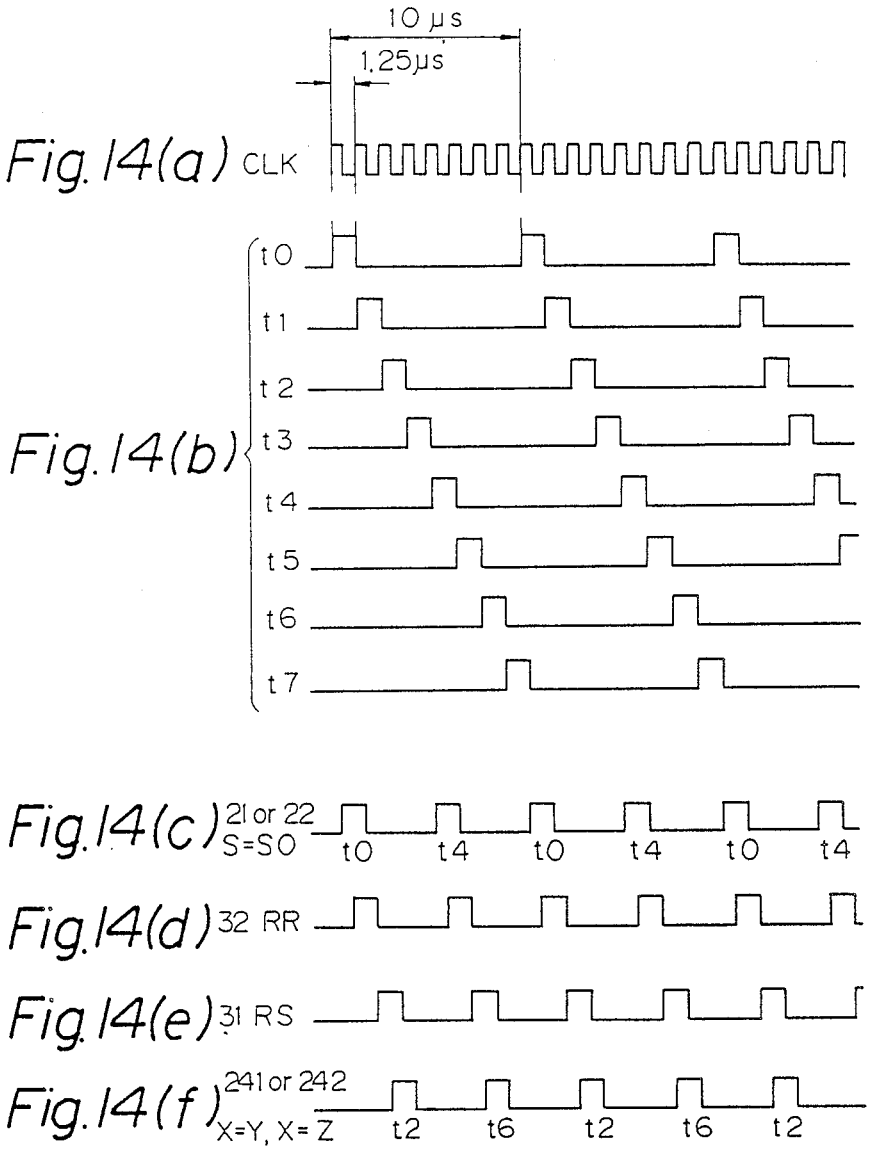
FIGS. 14(*a*) to 14(*b*), 14(*c*), 14(*d*), 14(*e*) and 14(*f*) are timing charts illustrating a clock signal (CLK), bit signal (t0–t7), light signal transmitting signal (SO) from the transmitter-receiver, light receiving signal (RR) at the relay unit, light transmitting signal (RS) by the relay unit, and light receiving signal (Y, Z) at the transmitter-receiver, respectively.

FIGS. 14(*a*) to 14(*f*) are timing charts illustrating a relationship between basic clock pulses, a bit signal a light emitting signal, and a light receiving signal. The basic clock signal is designated by CLK in FIG. 14(*a*); the bit signals are designated by t0 to t7 in FIG. 14(*b*); the light emitting signal for triggering the light emitting members 21 and 22 for measurement are designated by S0 in FIG. 14(*c*); the light receiving signals by the transmitter-receiver unit 2 is designated by Y and Z in FIG. 14(*f*); the light receiving signal by the relay unit 3 is designated by RR in FIG. 14(*d*); and the light transmitting signal by the relay unit 3 is designated by RS in FIG. 14(*e*). The measurement signal S0 from the infrared ray emitter 21 and 22 of the unit 2 is output between the bit signals t0 and t4 which are time intervals corresponding to 5 clock pulses (1.5×5=5 μs (micro seconds)), and the duration of the infrared ray measurement signal S0 is 1.25 μs in each of the time intervals of 5 μs. After a delay time, the light receiving element 32 of the relay unit 3 receives the signal at time intervals of 5 μs during the measurement. The light emitting element 31 of the relay unit 3 is triggered so that the output of the signal RS is delayed 1 bit from the receiving signal RR. This delay of the output RS signal from the input signal RR permits the output signal RS to be clearly discriminated from the signal caused by an inevitable reflection which occurs simultaneously, thereby increasing the sensitivity of the apparatus. Then, in the transmitter-receiver 2, the infrared ray receiver element 241 receive light (right hand signal) Y from the transmitter 3, and the infrared ray receiver element 242 receive light (left hand signal) Z from the transmitter 3. The reception of the lights Y and Z are carried out at the timing at which the bit signals t2 and t6 are output, respectively.

FIGS. 15(*a*) to 15(*k*) schematically illustrate the relationship between the intensity of light and time lapsed. In these figures, the light signals are described as continuous ray, but in practice can be pulsative lights as shown in FIG. 14. As shown in FIG. 15(*a*), the infrared ray pulsated signal SO (triggered for 1.25 μs at intervals of 5 μs) from the emitters 21 and 22 is operated for 20 ms (milliseconds). At an impact phase of one golf swing, the relay unit 3 issues the RS signal while the SO signal is received. The light receiving element 241 receives the RS signal as a received light signal Y or Z, and detects a sampling voltage V1. First, at the timing TR-R in FIG. 15(*d*), the right-side light receiving element 241 begins to receive the light signal. When the relay unit 3 is located at a position nearest to the light receiving element 241, the sampling voltage V1 reaches a peak voltage VP1. The time at which the peak voltage VP1 is obtained is referred to as a peak detecting time TP1. After receipt of the detected signal an analog to digital converter converts the sampling voltage V1 into a digital signal of 8 bits. When the peak voltage VP1 is reached, the corresponding voltage is stored in an 8-bit register for storing the peak value VP1. When the sampling voltage V1 begins to rise, a flip-flop UP F/F (FIG. 15(*j*)) is set. When the time TP1 for detecting the peak value is reached, the flip-flop UP F/F is reset, and a flip-flop for detecting the commencement of the decrease in the sampling voltage V1 from peak value, DOWN F/F (FIG. 15(*h*)) is set.

As a result, the timing when the UP F/F is reset or when the DOWN F/F is set is detected as the peak generating timing TP1 of the right side light receiving element 242. Similarly, the timing when the peak voltage TP2 in the sampling voltage V2 (FIG. 15(*e*)) by the left side light receiving element 242 is also detected by detecting the timing when the left side flip-flop UP F/F (FIG. 15(*k*)) is reset or when the left side flip-flop DOWN F/F (FIG. 15(*i*)) is set.

As clear from the above, the time difference T3 (FIG. 15) between the time TP1 of the output of the peak voltage VP1 of the right side light receiving unit 241 and the time TP2 of the output of the peak voltage VP2 of the left side light receiving unit 242 is calculated by the following equation.

$$T3 = TP2 - TP1$$

which is used for calculating the head speed as described later.

FIGS. 16(*a*) to (*d*) illustrate timing charts where a plurality of peaks of light intensity are generated. A counter for detecting the peak timing T1 is incremented when a V1 or V2 signal begins to rise (FIG. 16(*d*)). When the sampling signal V1 or V2 corresponding to the intensity in the light is input to the light receiving element 241 or 242, the flip-flop UP F/F (FIG. 16(*b*)) remains a set until the position A1 is reached, where the first peak appeared. After passing the peak position A1, the flip-flop UP F/F is reset, and a flip-flop DOWN F/F is set at a timing TPR1. This timing TPR1 is the time at which the first peak appeared and is detected as the number of the counter T1 (FIG. 16(*f*)), and memorized. Then, when the point B1 is passed, where the voltage exceeds the previous peak value VP1, the flip-flop UP F/F is again set, and the flip-flop DOWN F/F is reset. Then, at timing TPR2, the voltage value attains a new peak A2, the flip-flop UP F/F is reset, and the flip-flop DOWN F/F is set. This timing TPR2 as the time of a generation of a peak is stored in the LSI, and at the same time, the previous peak timing TPR1 is erased. Similarly, at position B2 where the value exceeds the previous peak A2, the flip-flop UP F/F is reset, and DOWN F/F is reset. When passing another peak position A3, the flip-flop UP F/F is reset, and a flip-flop DOWN F/F is set, at a timing TPR3. This timing TPR3 is memorized in the LSI and TPR2 is erased. As clear from the above, the timing at which the maximum peak voltage is obtained is memorized in the LSI by moving a peak value higher than the preceding peak value into the memory. In an example shown in FIG. 16, the timing TPR3 is memorized as the timing TP1 for attaining the maximum peak value.

Figures 17A, 17B, 17C, 17D, 17E, 17F:
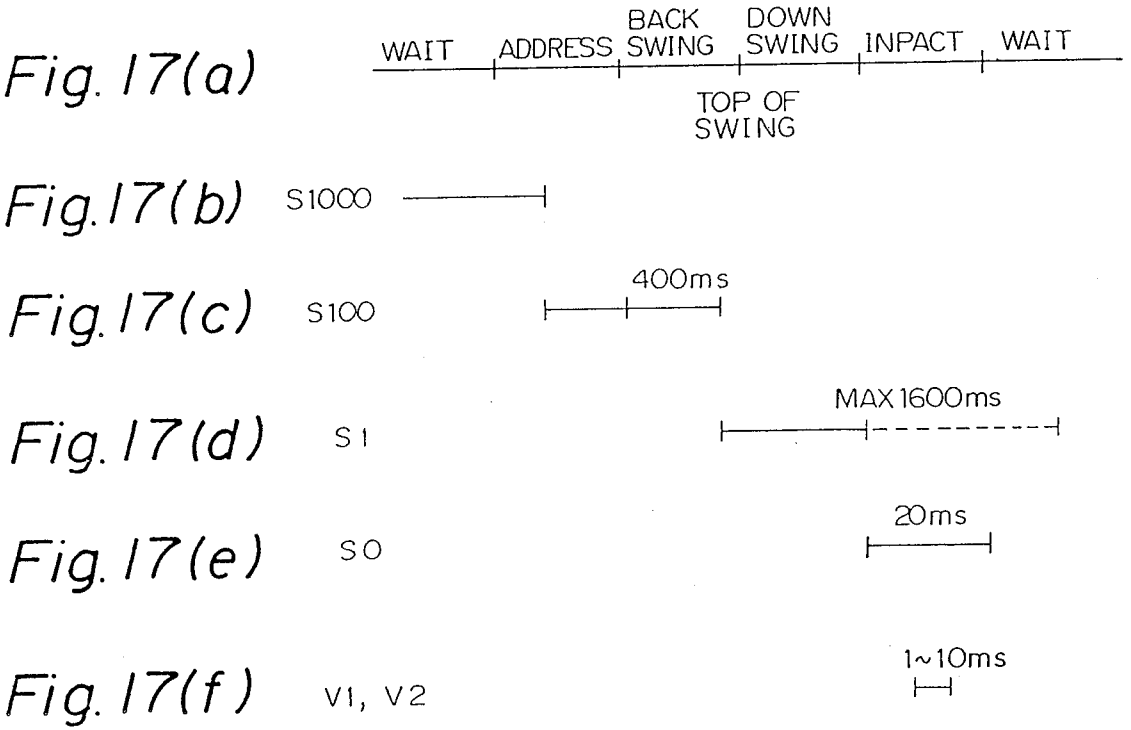
FIGS. 17(*a*), 17(*b*), 17(*c*), 17(*d*), 17(*e*) and 17(*f*) are timing charts illustrating phases of one swing of a golf club, an S1000 signal issued once in 1000 ms an S100 signal issued once in 100 ms, an S1 signal issued once in 1 ms, an S0 signal for measurement, and sampling signals V1 and V1, respectively.

FIGS. 17(*a*) to (*f*) are timing charts illustrating the relationship between the various phases of a golf swing and the infrared ray signal. In FIG. 17(*b*), S1000 is a light generating signal issued once for 1000 ms. This S1000 signal is used for controlling the waiting phase. In FIG. 17(*c*), S100 is a light generating signal issued once for 100 ms. This S100 signal is used for controlling the address phase. In FIG. 17(*d*), S1 is a light generating signal issued once for 1 ms. This S1 signal is used for controlling the commencement of the measurement by the present invention. In FIG. 17(*e*), SO is a light generating signal issued once for 5 μs. The S1000, S100 and S1 light signals emitted form the infrared ray element 23 are search signals, and the SO light signal is emitted form the infrared ray emitter elements 21 and 22 for measurement.

After a back swing phase has commenced, the S100 signal operated for a time of 400 ms, the S1 signal is operated for 1600 ms, and the SO signal is operated for 20 ms. The duty ratio, i.e., the frequency of the operation per unit time of these signals, is controlled in accordance with the condition of the swing.

In FIG. 17(*f*), if the SO signal operates for 20 ms, the voltage level of the sampling signal due to the receipt of light by the right receiving element 241 is designated as V1, and the voltage level of the sampling signal due to the receipt of light by the left receiving element 242 is designated as V2.

Figure 18:
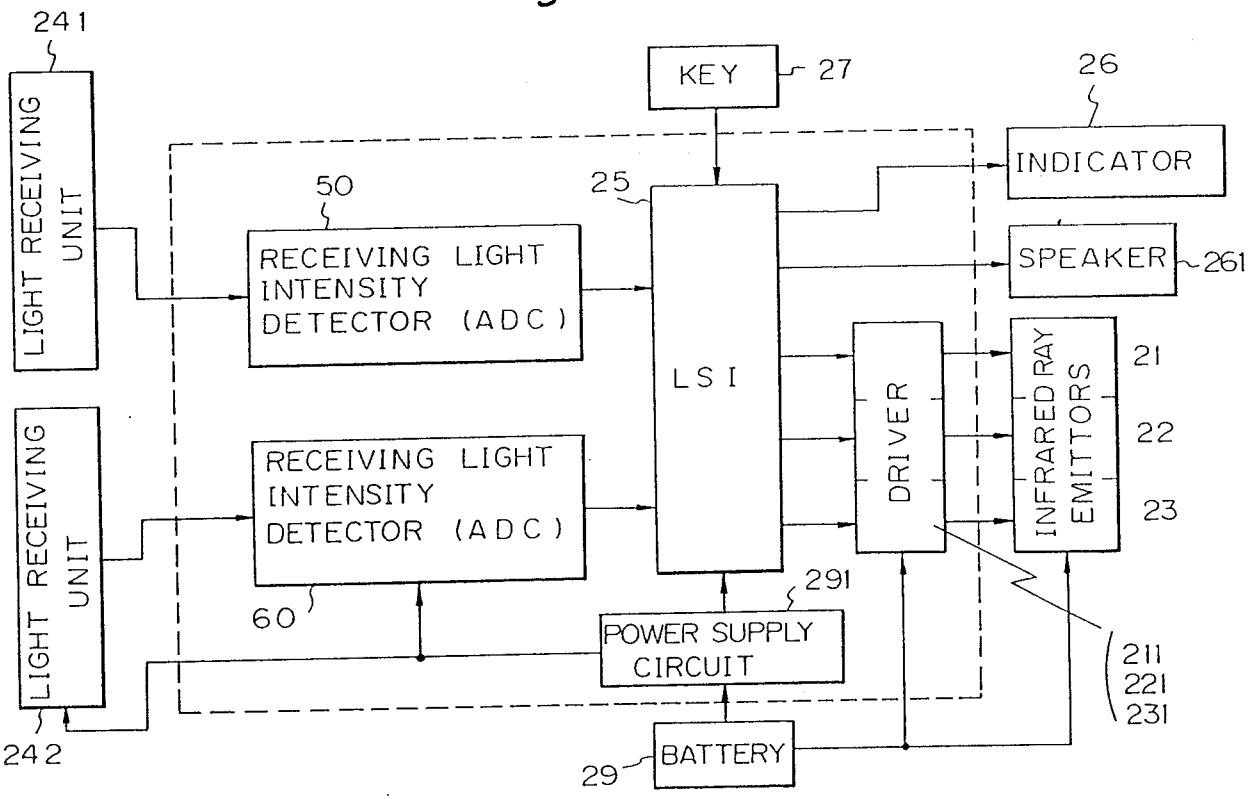
FIG. 18 is a block diagram of the transmitter-receiver.

In FIG. 18 illustrating a diagrammatic view of a electric control circuit in the transmitter-receiver unit 2, the control circuit includes a programmable LSI 25, and the infrared light emitters already described are designated 21, 22 and 23, respectively. The LSI 25 is connected to the infrared ray emitters 21, 22 and 23, via respectively drive circuits 211, 221, and 231, as an electric current amplifier. The light receiving elements 241 and 242, as already explained, are connected to the LSI 25 via receiving light intensity detector units 50 and 60, respectively as an analogue to digital converter. These units 50 and 60 convert the intensity of the light to a level of a voltage, and the voltage is then converted to a digital signal of 8 bits and supplied to the LSI 25. Furthermore, a signal corresponding to the timing of the generation of the peak level is input to the LSI, and the LSI sequentially memorizes that timing. The electronic circuit is connected to the liquid crystal indicator 26, an alarm unit 261, key unit 27 and a power supply circuit 291 connected to a battery unit 29, to ensure that a stabilized electric current is supplied to the LSI 25, the infrared ray receiving elements 241 and 242, and indicator unit 26. The battery unit 29 comprises two oxide silver batteries, each generating an electric current of 1.5 volts.

Figure 19:
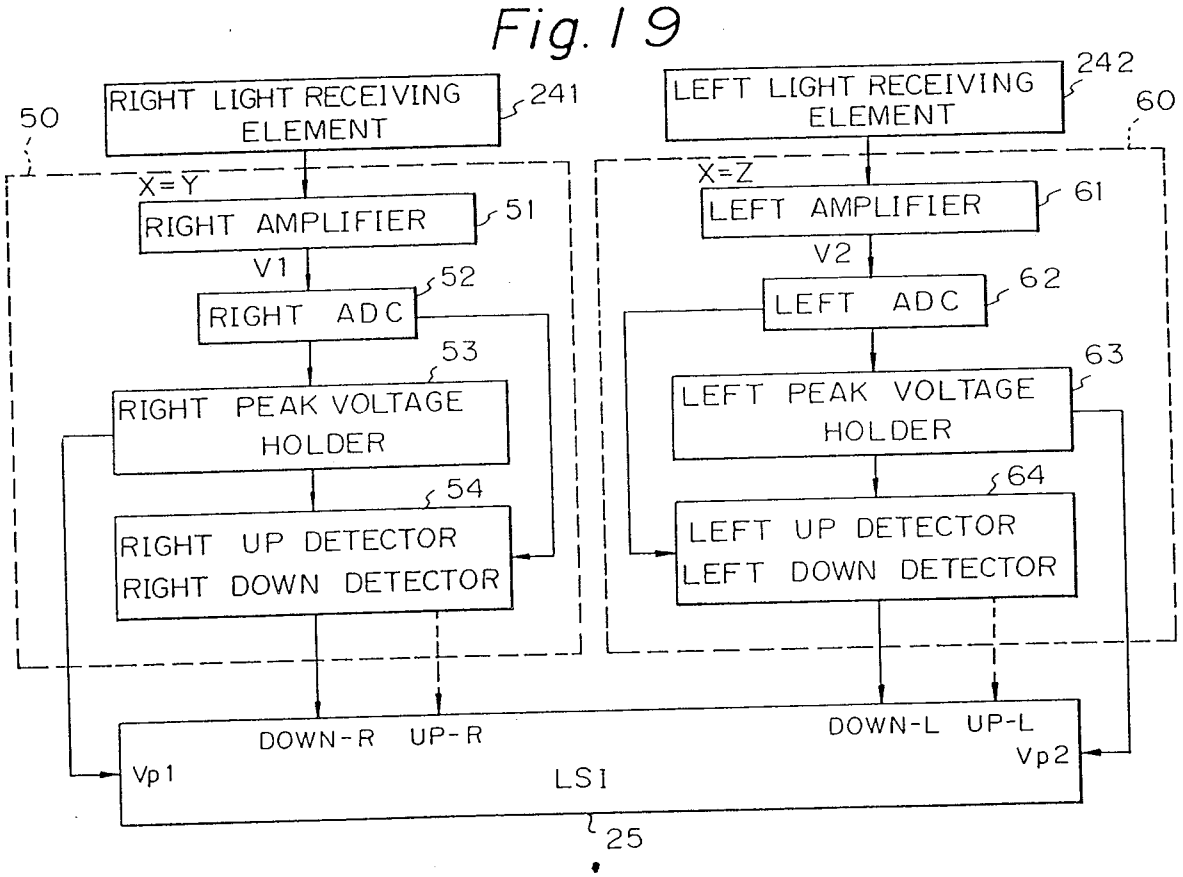
FIG. 19 is a block diagram of the receiving light detectors in FIG. 18.

FIG. 19 is a block diagram of the units 50 and 60 for detecting an intensity of the received light signal. The unit 50 includes an amplifier 51 connected to the right side light receiving unit 241 as a light receiving unit Y where at the measuring signal SO is received. At the amplifier 51, the signal is amplified to a level V1 within a limit of non-saturation, and is sent to an analog to digital converter unit 52. The AD converter unit 52 allows the signal to be input only while the measuring signal SO is operated, and therefore, an input of the signal is prohibited during the remaining period. This allows the sampling to be carried out only during the impact phase of the swing (FIGS. 17(*a*) and (*e*)). The AD converter unit 52 converts the voltage as sampled into digital signal of 8 bits. A peak holding unit 53 to which the converted 8 bit signal is input is connected to the AD converter 52. At the peak holding unit 53, a comparison of the newly introduced voltage level as an 8 bit signal with a memorized voltage level as an 8 bit level is carried out. When it is determined that the newly introduced voltage level as an 8 bit signal is larger than the memorized voltage level as an 8 bit level, the newly introduced value is memorized and the old value is erased. Connected to the peak holder 53 is a unit 54 having a flip-flop UP F/F (FIG. 15(*j*)) which is set when the sampling voltage is larger than the peak level memorized in the peak hold unit 53. The unit 54 also has a flip-flop DOWN F/F (FIG. 15(*h*)) which is set when the sampling voltage is smaller than the peak level memorized in the peak hold unit 53. Therefore, the UP F/F is set just before the peak level is reached, and the UP F/F is reset and the DOWN F/F is set just after the peak level is reached. The reset signal of the UP F/F and reset signal of DOWN F/F are introduced into a port DOWN-R or UP-R of the LSI 25 (FIG. 19), so that the timing TPl for the generation of the peak level can be detected.

The unit 53 is directly connected to the Vp1 port of the LSI 25 for introducing the value Vp1. Just after the signal SO of the light emitting elements has operated for 20 ms, the peak voltage value VP1 as an 8 bit form stored in the peak voltage level holder 53 is input to the LSI 125. The LSI 25 carries out the designated operation in accordance with a program stored therein, based on the peak voltage value VPI and time TP1 for generating the peak voltage as basic data.

The left side light receiving element 242 is connected to the unit 60 for detecting the intensity of light received by the element 242. The unit 60, as with the unit 50, is provided with units 61, 62, 63, and 64. The operation of the unit 60 is the same as that of unit 50, and therefore, a detailed explanation thereof is omitted.

Figure 20:
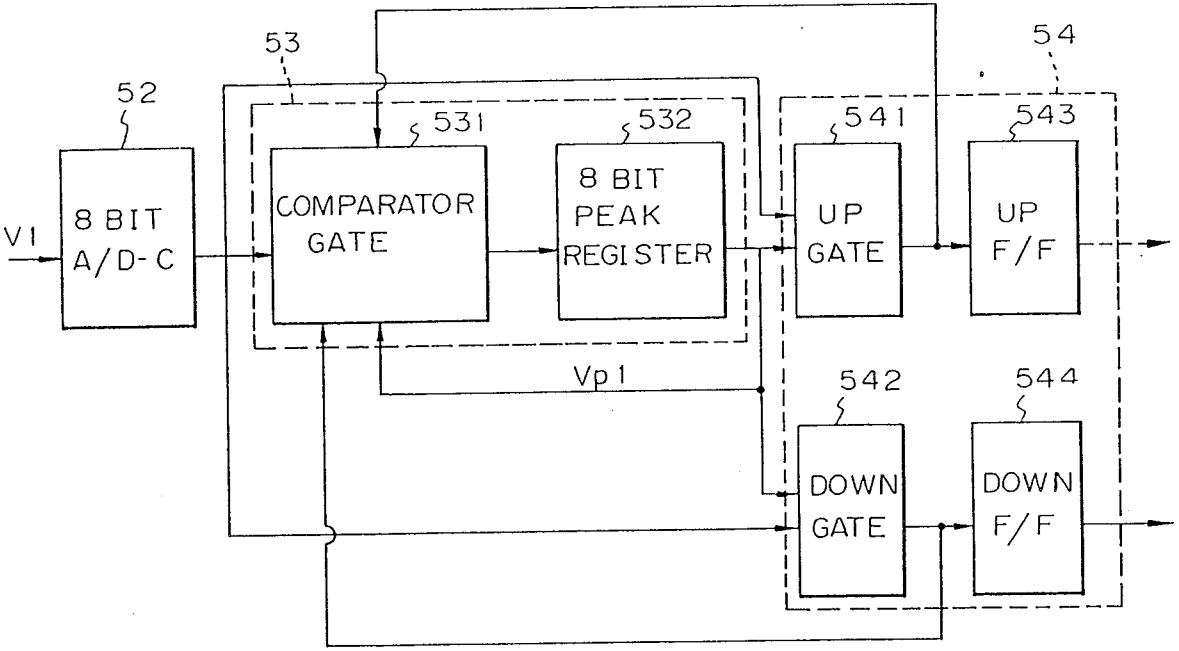
FIG. 20 is block diagram of the input gates and up and down detectors in FIG. 19.

FIG. 20 is a detailed block diagram of the peak voltage holder unit 53 and the detector unit 54 of the timing for reaching the peak voltage. The peak holder unit 53 includes a comparator unit 531 having an input connected to the A-D converter 52, by which the sampling voltage analog signal V1 is converted into a digital signal of 8 bits, and an 8 bit register 532 for storing a peak value. The detector unit 54 includes an UP Gate 541 as a comparator having an input connected to the output from the register 532 and an input connected to the output of the A-D converter 52, an UP F/F 543 having an input connected to the output of the UP Gate 541, a DOWN Gate 542 as a comparator having an input connected the output from the register 532 and an input connected to the output of the A-D converter 52, and a DOWN F/F 544 having an input connected to the output of the UP Gate 541.

The comparator gate 531 compares, sequentially bit to bit from the most significant bit, the output signal VP1 stored in the register 532 with the output signal from the output of the A-D converter 52. When it is determined that the value of V1 output from the A-D converter 52 is larger than the stored value VP1 in the register 532, the gate 541 issues a signal to the UP F/F so that the UP F/F is set, and at the same time the output level V1 is moved into the 8 bit register 532 instead of the old value. When it is determined that the value of V1 output from the A-D converter 52 is smaller than the stored value VP1 in the register 532, the gate 541 issues a signal to UP F/F so that the UP F/F is reset.

When it is determined that V1 is smaller than VP1, the DOWN gate 542 sets the DOWN F/F 544, and the output VP1 from the register 532 for holding the peak value is again introduced to the input of the register 532. When it is determined that V1 is smaller than VP1, the DOWN gate 542 resets the DOWN F/F 544, and the output VP1 from the register 532 for holding the peak value is again introduced to the input of the register 532.

From these operations it will be easily seen that the peak level of the voltage V1 is memorized in the register 532 in the form of an 8 bit digital signal, and simultaneously, the set signal to the DOWN F/F is introduced to the LSI 25 so that a detection of the timing TPR1 by the LSI 25 is realized. It should be noted that the construction and operation of the left-hand units 63 and 64 is the same as in FIG. 20, and thus a description thereof is omitted.

Figure 21:
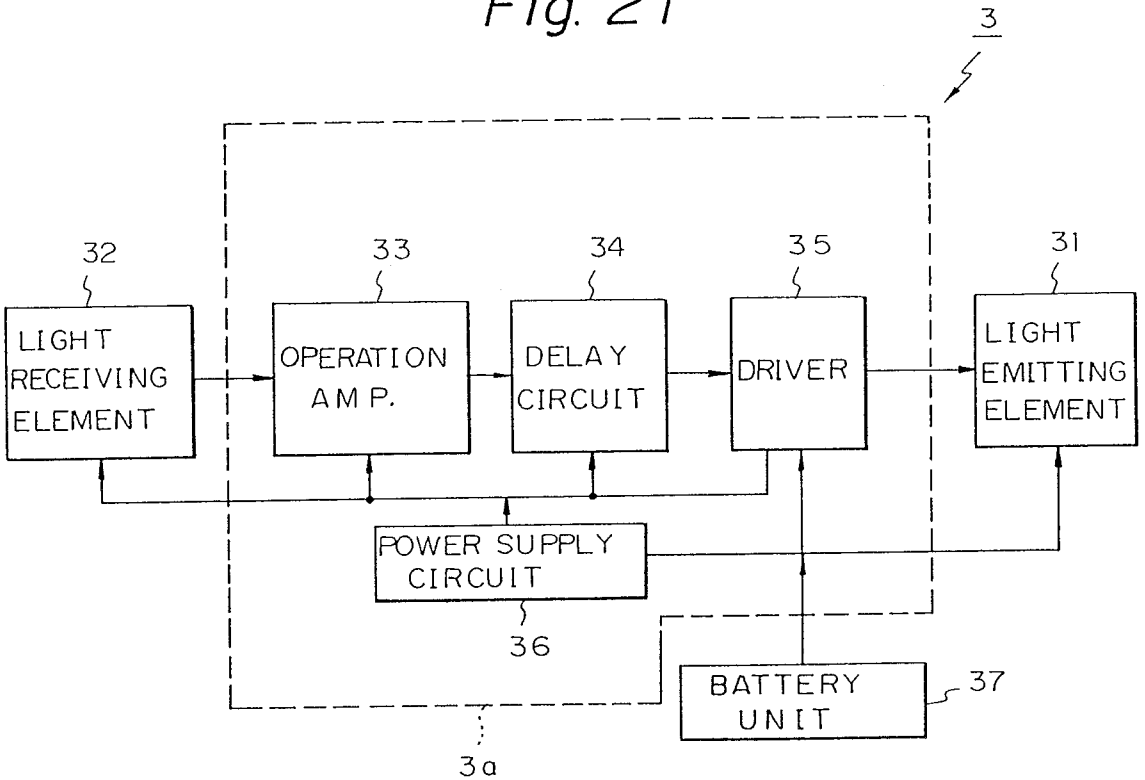
FIG. 21 is a block diagram of the relay unit.

FIG. 21 is a diagrammatic view of the relay unit 3 arranged between the light receiving element 32 and light emitting element 31. The relay unit 3 includes an LSI 3*a* having an operational amplifier 33, a delay circuit 34, a driver 35, and power supply circuit 36 supplied by a battery unit 37 including two silver oxide batteries.

The infrared ray signal is received by the light receiving element 32, which is amplified by the amplifier 33. The detected signal is delayed for 1 bit by the delay circuit 34, as shown by FIGS. 14(*d*) and (*e*). This delay enables a discrimination of the detected signal from a reflected signal. The drive 35 amplifiers an electric current so that the light emitting element 31 generates infrared rays. It should be noted that the power supply circuit 36 is used to stabilize the voltage from the battery unit 37 before it is supplied to the element 32, amplifier 33, and delay circuit 34.

Figures 22, 22A, 22B:
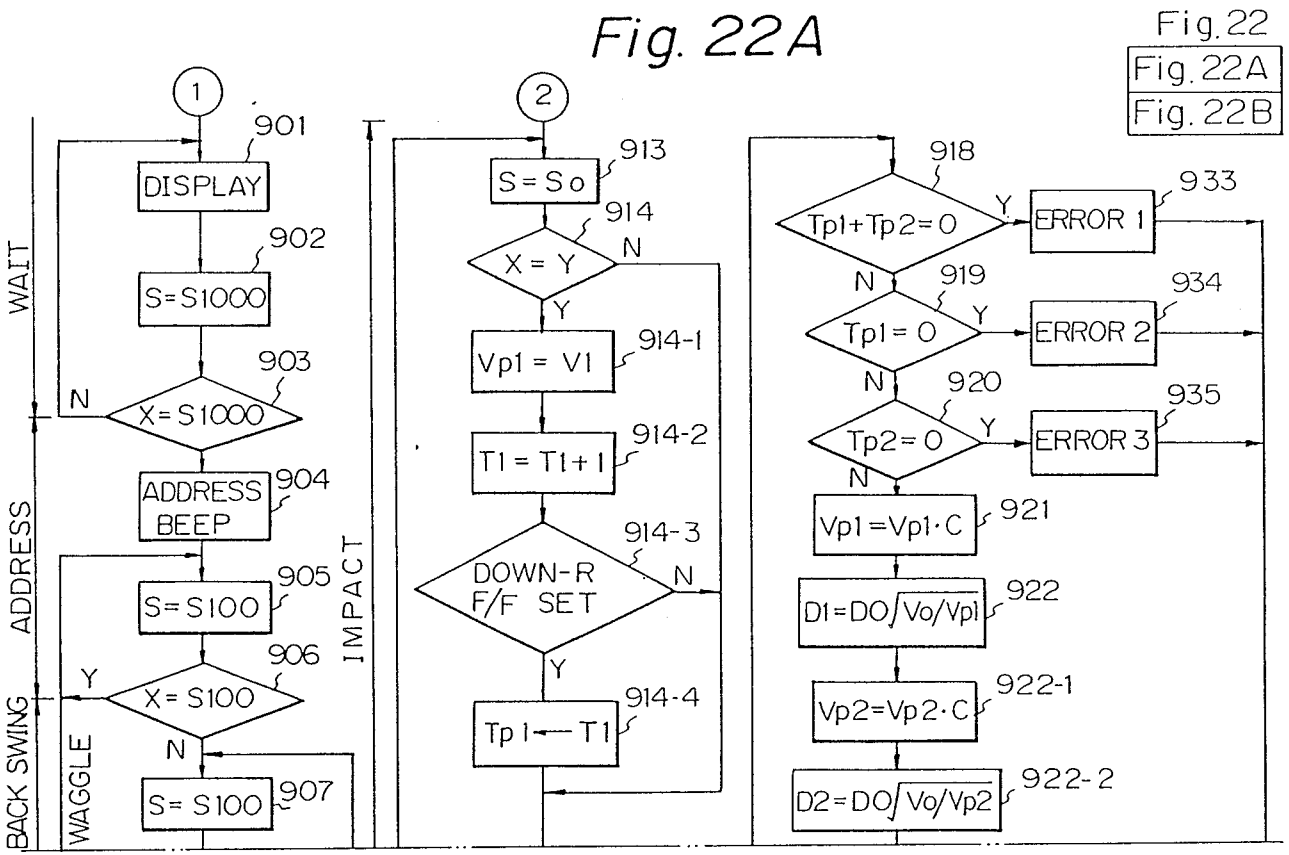
FIG. 22A and 22B are two parts to a flow chart for attaining the measurement of the golf club's speed, inclination and passage of movement.
Figure 22B:
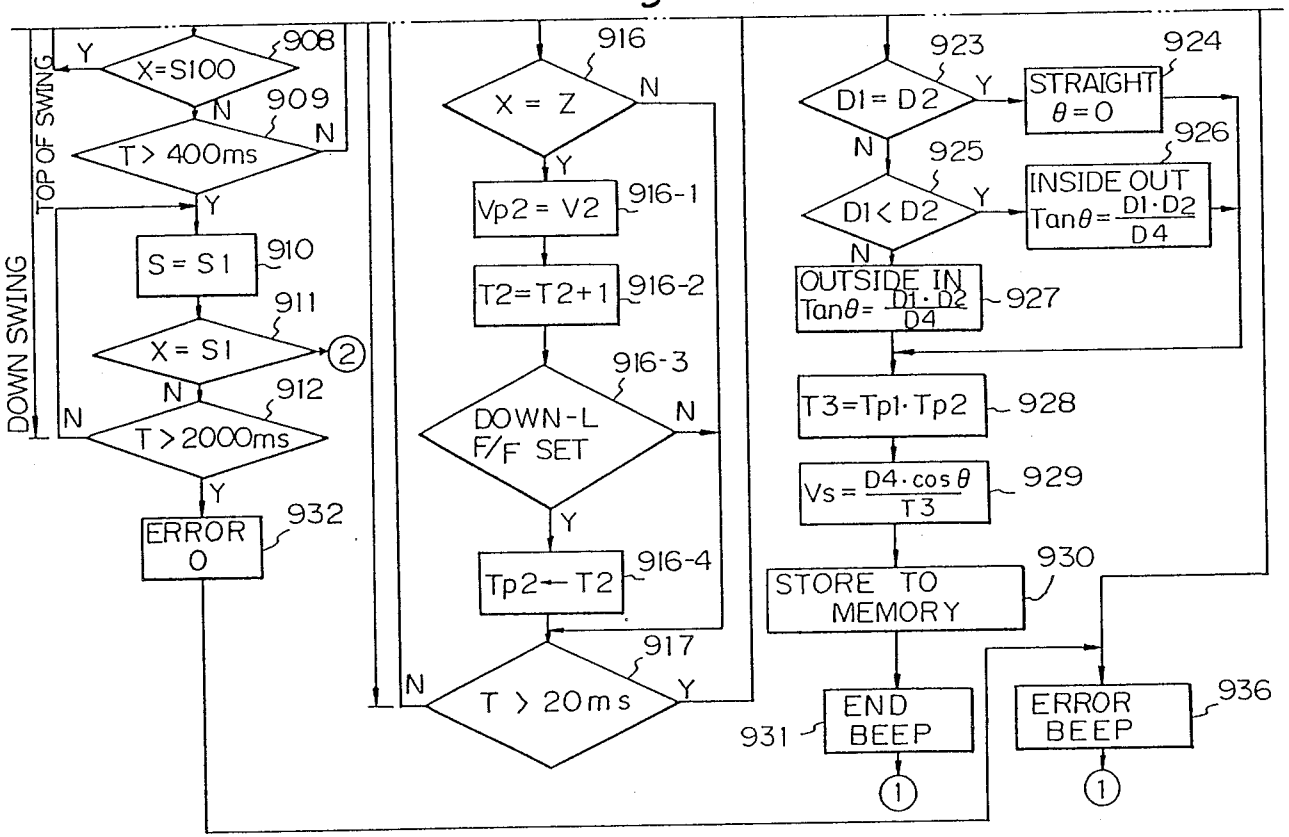

FIG. 22 illustrates a flowchart for the programs stored in the LSI 25 for measuring the speed, direction of movement and inclination in the passage of the golf club head during a swing. When the key 27 is operated, a program is executed for measuring the speed and the direction of the passage of the golf club head during a swing. At step 901, the number of the swing and speed of the head at the preceding cycle are displayed for a predetermined period of, for example, 1 second. At step 902, a search signal S1000 is issued once every 1000 milliseconds. At step 903, it is determined whether or not a resultant signal received by the light receiving elements 241 and 242 exists, which means that the head 1 is properly located with respect to the practicing apparatus 2 as shown in FIG. 1. If the receiving signal does not exist, the head 1 is not properly located. In this case, the routine goes from step 903 back to step 901 until the head is properly located.

When it is detected that light is received at step 903, the routine goes to step 904, where a signal is issued to the speaker 261 to issue a sound to notify the user that the head is properly located. Then, at step 905, a search signal switched to S100 is issued to the infrared ray emitter 23 for a searching, which search is made at intervals of 100 ms. Then, at step 906, it is determined whether or not the resultant light exists in the light receiving elements 241 and 242. Upon detection of the light, the routine goes from step 906 back to step 905, and this sequence is repeated during the addressing phase of the swing.

When a take back is commenced, detection of the searched light at step 906 is not possible, and the routine goes to step 907, where a search signal S100 is issued to the light emitting element 23 for a search at every 100 milliseconds. Next, at step 908, it is determined that the resultant received light exists. When the take back phase is continued, the routine goes to step 909 where it is determined whether 400 milliseconds has elapsed. The routine of steps 907 to 909 is repeated until 400 milliseconds has elapsed form the start of the take back phase. See FIG. 17(*c*). When it is determined that the light exist within a period shorter than 400 ms, this means that a waggling movement of the head has occurred. In this case the routine goes back to step 905 for the address phase.

When 400 milliseconds have elapsed from the commencement of the take back phase, the routine goes from step 909 to step 910, the search signal is switched to S1 and operates once every 1 millisecond, to further increase the search speed.

Then, at step 911, unless the resultant receiving signal is detected, the routine goes to step 912 where it is determined whether a predetermined time of 2000 milliseconds has elapsed from the start of the take back phase. The routine repeats steps 910 and 912 between the top of the swing and the start of the down swing.

When the head is adjacent to the impact phase, an existence of the search signal S1 is detected at step 911. Then, the routine goes to step 913 where the infrared ray signal S0 is issued, and is flashed for a duration of 1.25 μs every 5 μs. Then, at step 914, it is determined whether the Y signal is received by the right side light receiving unit 241. If the Y signal is received, the routine goes to 914-1, where the peak value V1 from the peak voltage holder 53 is moved to a memory area in the LSI for storing the peak voltage Vp1. Then, at step 914-2, the timer T1 for counting the lapse of time from the receipt of the light T1 (FIG. 16(*d*)) is incremented. At step 914-3, it is determined whether a set signal has been sent to the DOWN F/F (544 in FIG. 20), i.e., the occurrence of a peak. If a peak has occurred, the routine goes to step 914-4, where the value of the counter T1 as the timing of the peak is moved to Tp1, and these values are stored in the respective memory areas. Then, at step 916, it is determined whether the Z signal has been received by the left side light receiving unit 242. If the Z signal has been received the routine goes to 916-1, where the peak value V2 from the peak voltage holder 63 is moved to a memory area in the LSI for storing the peak voltage Vp2. Then, at step 916-2, the timer T2 for counting the lapse of time from the receipt of the light is incremented. At step 916-3, it is determined whether a set signal has been sent to the DOWN F/F, i.e., the occurrence of a left side peak. If a peak has occurred, the routine goes to step 916-4, where the value of the counter T2 as the timing of the peak is moved to Tp2, and these values are stored in the respective memory areas. Then, at step 917, it is determined whether a predetermined time of 20 milliseconds during an impact phase has elapsed. During the impact phase, the routine between steps 913 and 917 is repeated, wherein the peak level of the intensity of the received light is converted to the peak value of a voltage level, which is memorized. When it is determined at step 917 that 20 milliseconds has elapsed from the commencement of the impact phase, the routine goes to the following steps.

It should be noted, that at step 914-3 or 916-3, a reset of the UP F/F can be detected instead of a set of the DOWN F/F for detecting the timing of the peak of the intensity of the received light. See FIG. 15 or 16.

At steps 918 to 920 the timing for generation of the peak is checked. When it is determined that the measured time TP1+TP2 or TP1 or TP2 is zero at step 918 or 919 or 920, the routine goes to step 933 or 934 or 935, where an error 1 or error 2 or error 3 routine is carried out. When a result of the timing of the generation of the peak voltage is measured, the routine goes to step 921, where the voltage level Vp1 is obtained by multiplying a predetermined constant C to the peak voltage value Vp1. This C is a converting factor used by the A/D converter 52. Then, at step 922, the distance D1 between the relay unit 3 and the right side receiving unit 241 of the transistor-receiver 2 when the maximum intensity is obtained is calculated by, $$D1 = D0\sqrt{V0/Vp1},$$

where V0 is a reference voltage level obtained from the reference distance between the transmitter receiver 2 and relay unit, i.e., the head of the club. This equation is based on the fact that the distance from the light source is proportional to the root of the intensity of the light. At step 922-1, the voltage level Vp2 is obtained by multiplying a predetermined constant C to the peak voltage value Vp2. Then, at step 922-2, the distance D2 between the relay unit 3 and the right side receiving unit 242 of the transmitter-receiver 2 when the maximum intensity is obtained is calculated by, $$D2 = D0\sqrt{V0/Vp2}.$$

At step 923, it is determined whether D1 is equal to D2, i.e., that the swing was straight. When the result is YES, the routine goes to step 924, where a zero value is moved to θ, and when the result is NO, the routine goes to step 925, where it is determined that D1<D2, i.e., that the swing was inside-to-outside. If the result of judgement at step 925 is YES, the routine goes to step 926, where the swing angle for an inside-to-outside swing is calculated by, $$\tan\theta = (D1 - D2)/D4.$$

When the result at step 925 is NO, the routine goes to step 927, where the swing angle for an outside-to-inside swing is calculated by $$\tan\theta = (D1 - D2)/D4.$$

After step 924, 926 or 927, the routine goes to step 928 where the time difference T3 between the times at which the peak voltages are issued, i.e., TP1−TP2, is calculated. At step 929, the head speed is calculated by $$Vs = D4\cos\theta/T3.$$

At step 930, the calculated swing angle θ and head speed are stored in the memory and the routine goes to step 931 to emit a sound, and then the routine goes back to the initial point, i.e., step 901, where the measured head speed, swing pass angle, and other factors are displayed.

When at step 912, a received signal is not detected within 2000 milliseconds, it is determined that a swing has not been made and the routine goes to step 932 to issue an error 0 signal. At step 918, when it is judged that TP1+TP2 is zero, it is determined that the swing is outside the normal passage, and then, routine goes to step 933 to issue an error 1 signal. At step 919, when it is judged that TP1=0, it is determined that an extreme outside-to-inside swing has occurred, and the routine goes to step 934 to issue an error 2 signal. At step 929, when it is judged that TP2=0, it is determined that an extreme inside-to-outside swing has occurred, and the routine then goes to step 934 to issue an error 3 signal.

Upon the occurrence of an error, the measurement is temporarily stopped, an error sound is issued, at step 936 and at step 901, the error number is displayed.

Figure 23:
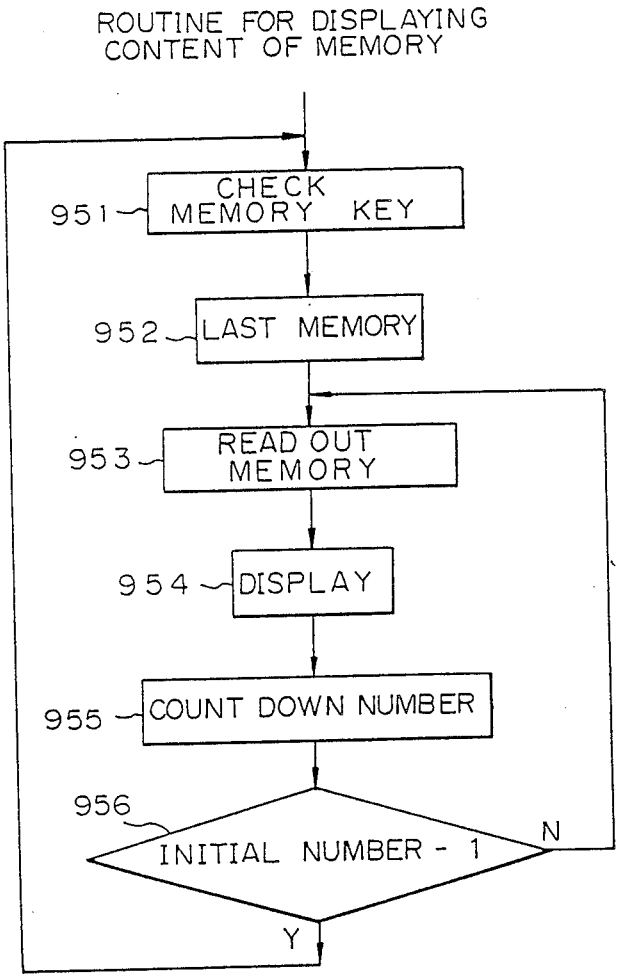
FIG. 23 is a flow chart for reading out the content of the memory.

FIG. 23 shows a flowchart corresponding to a program for reading out the content of the memory. When the memory key is operated (step 951), the address of the memory where the result of the latest swing is stored is addressed at step 952. Then, at step 953, the content of the address is read out. At step 954, the content, i.e., the number of the last swing and the angle of the swing passage, are displayed, and at step 955, swing number is counted down, and displayed sequentially from the first swing number. For example, if the memory has a volume for 100 swings, and 250 swings were made, first the swing number 250 and the swing angle thereof are shown, and then the swing number and angle are sequentially displayed until the number is decreased to 151.

In the embodiment as shown the relay unit 3 is mounted on the toe of the head, but the relay unit 3 can be mounted on a portion other than that shown, for example, in a lower part of the shaft near the head.

According to the electronic apparatus used when practicing a golf swing, a change in the intensity of light from the relay unit at the impact phase is detected by the transmitter receiver, permitting the head speed to be measured, and because the inner electric circuit is constructed by an LSI, and easily portable apparatus is obtained, allowing practice at any place, such as a small area garden of a house, and at any time, such as during a round of golf.

While the embodiment of the invention is described with reference to the attached drawing, many modifications and changes can be made by those skilled in the art without departing from the scope and spirit of the present invention.

I claim:

1. An apparatus used when practicing a golf swing, comprising:

a golf club having a shaft and a head;

a first light transmitting means for generating a beam of light substantially parallel to the ground;

first and second light receiving means located at the sides of the first light transmitting means for receiving light, said first light transmitting means and said first and second light receiving means being stationarily arranged on the ground so as to face a head of the golf club at a position corresponding to an impact region in a passage of the head during a swing;

relay means, mounted in the head of the golf club or adjacent thereto, for relaying the light from said first light transmitting means to said first and second light receiving means during a swing;

first processing means, responsive to an elapsed time period corresponding to an intensity of light received by said first light receiving means during a club swing, for obtaining a first distance between the head and the first light receiving means;

second processing means, responsive to an elapsed time period corresponding to an intensity of light received by said second light receiving means during a club swing, for obtaining a second distance between the head and said second light receiving means; and means for calculating a head trajectory angle of the swing based on the first and second distances, said head trajectory being at least one of an angle of inclination of a club face and an angle of inclination of an axis of said club swing with respect to a golf ball.

2. An apparatus according to claim 1, wherein said relay means comprises:

a third light receiving means arranged on the golf club in or adjacent to the head thereof for receiving light from said stationary first light transmitting means;

a second light transmitting means arranged on the head for transmitting a light corresponding to the light received by said third light receiving means to the stationary first and second light receiving means; and phase control means arranged between said third light receiving means and said second light transmitting means for controlling the phase between the light received by the third light receiving means and the light transmitted by the second light transmitting means, and for generating a time delay between the time said third light receiving means receives said beam of light and the time when said second light transmitting means transmits a second beam of light, wherein said phase control means discriminates between signals detected by said first and second light receiving means from a reflected signal.

3. An apparatus according to claim 2, wherein said phase control means controls the phase difference so that a one bit phase difference is obtained between the light received by said third light receiving means and the light transmitted by the second light transmitting means.

4. An apparatus according to claim 1, wherein said first processing means includes first detecting means for detecting a maximum intensity of a light received by the first light receiving means, and means for calculating the first distance based on the first maximum intensity; and wherein said second processing means comprises second detecting means for detecting a second maximum intensity of light received by the second light receiving means, and means for calculating the second distance D2 based on the second maximum intensity.

5. An apparatus according to claim 4, wherein each of said first detecting means and said second detecting means comprises:

a means for obtaining an electric signal indicating the intensity of the received light;

a register means for storing the value of a prior electric signal; and a comparing means for comparing a value of the electric signal now received with the value of the prior electric signal in the register means, for updating the register means.

6. An apparatus according to claim 4, wherein said calculating means for calculating the head trajectory angle comprises:

a timing means for generating a timing signal for a small period;

first detecting means operating synchronously with said timing means for detecting a first time for obtaining the first distance between the head and said first light receiving means;

second detecting means for detecting a second time for obtaining the second distance between the head and said second light receiving means;

means for calculating a difference between the first and second times obtained by said first and second detecting means; and mean for calculating a head speed based on the calculated time difference and the first and second distances.

7. An apparatus according to claim 6, wherein each of said first detecting means and said second detecting means comprises:

a timer counter for counting a number of timing pulses;

means for transforming the intensity of light to an electric level signal;

register means for storing an electric value corresponding to the peak value of the intensity of light received by said first and second receiving means respectively;

comparing means for comparing the detected level with a stored peak value to update said register means; and means for storing the value of said counter when the peak value is updated, the stored value of said counter obtaining the finally updated peak value as the timing of the detecting of the peak of the received light.

8. An apparatus according to claim 7, further comprising means for determining a swing error from the content of the stored value of the time corresponding to an initial value of the counter.

9. An apparatus according to claim 1, further comprising means for visually displaying the content of a swing angle.

10. An apparatus according to claim 9, further comprising means for storing data of swing characteristics for a plurality of swings, and means for sequentially displaying the stored data of swing characteristics up to the completion of a count down of the number of swings.

11. An apparatus according to claim 1, wherein said first light transmitting means and said first and second light receiving means are arranged as a unit which is fixed in the ground in the same way as a golf tee.

12. An apparatus according to claim 1, wherein the light issued from the said first light transmitting means or the light relayed by said relay means is an infrared ray.

13. An apparatus according to claim 1, further comprising means for monitoring a condition of a swing up to an impact phase for commencing operation of said first and second processing means after the impact phase is reduced.

14. An apparatus according to claim 13, wherein said monitoring means comprises:

means for emitting a search beam toward the club head;

timer means for determining an elapse of time from an address phase to the impact phase of the swing;

means for detecting the search beam by said first and second light receiving means;

means for determining from a time longer than a first predetermined value upon said detection that the impact phase has been reached; and means for issuing a trigger signal to said first and second processing means to commence operation when the impact phase has been reached.

15. An apparatus according to claim 14, further comprising means for warning that an address is properly set, to allow said timer means to commence operation.

16. An apparatus according to claim 14, further comprising means for determining, from said time shorter than a second predetermined value smaller than a first predetermined value when the search beam is detected, that the club head has been waggled, and means for clearing said timer means.

17. An apparatus according to claim 14, further comprising means for determining, when a search beam is not detected after said first predetermined time value has elapsed, that the swing is erroneous.

* * * * *